US007010241B2

(12) United States Patent
Nakayama

(10) Patent No.: US 7,010,241 B2
(45) Date of Patent: Mar. 7, 2006

(54) IMAGE FORMING APPARATUS, IMAGE FORMING METHOD, AND FIXING DEVICE THEREOF

(75) Inventor: Hiroshi Nakayama, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/805,331

(22) Filed: Mar. 22, 2004

(65) Prior Publication Data

US 2005/0207773 A1 Sep. 22, 2005

(51) Int. Cl.
*G03G 15/20* (2006.01)

(52) U.S. Cl. ..... 399/69

(58) Field of Classification Search ..... 399/69, 399/358, 328

See application file for complete search history.

(56) References Cited

U.S. PATENT DOCUMENTS 5,899,599 A * 5/1999 Kato ..... 399/69
6,011,938 A * 1/2000 Toizumi ..... 399/69
6,061,546 A * 5/2000 Sawamura et al. ..... 399/358
6,188,054 B1 2/2001 Ohta
6,301,454 B1 * 10/2001 Nishida et al. ..... 399/69
6,333,490 B1 * 12/2001 Higashi et al. ..... 219/216

FOREIGN PATENT DOCUMENTS

JP 2002-215976 A 8/2000
JP 2001-126856 A 5/2001
JP 2001-185338 A 7/2001
JP 2002-40872 A 2/2002

* cited by examiner

*Primary Examiner*—William J. Royer
(74) *Attorney, Agent, or Firm*—Foley & Lardner LLP

(57) ABSTRACT

An image forming apparatus having a forming unit which forms an image onto a recording medium on the basis of acquired image information, a fixing unit which fixes the formed image by heating the recording medium onto which the image has been formed by the forming unit, and a control unit which detects temperatures of the fixing unit and generates a temperature change table, and which carries out temperature control on the basis thereof.

10 Claims, 6 Drawing Sheets

IMAGE FORMING APPARATUS, IMAGE FORMING METHOD, AND FIXING DEVICE THEREOF

BACKGROUND OF THE INVENTION

Recently, accompanying improvements in the performance of image forming apparatuses such as digital copiers, integrated digital devices having not only a copying function, but also a function as a printer have been developed and popularized. In such an image forming apparatus, even more added value with respect to the respective functions have been required.

Namely, in the image forming apparatus, an image formed on a recording medium is fixed by a fixing device such as a fixing roller, and is discharged. With respect to the temperature control of the fixing roller here, there are various prior arts.

In Jpn. Pat. Appln. KOKAI Publication No. 2001-185338, "Induction Heating Device and Image Processing Device Equipped with Same" is disclosed, and there is disclosed a technique in which a plurality of induction coils are connected in parallel, and the current supplies to only some coils and to the plurality of coils are respectively switched by switching operations, and a desired temperature distribution can be obtained.

Further, in Jpn. Pat. Appln. KOKAI Publication No. 2002-40872, there is disclosed a technique in which the end portions and the central portion of a heating roller in an induction heating type fixing device are detected, and by varying the switching frequency in accordance with the temperature difference thereof, the temperature distribution of the heating roller is made to be uniform.

Furthermore, in Jpn. Pat. Appln. KOKAI Publication No. 2001-126856, there is disclosed a technique in which, in an induction heating type fixing device, a temperature difference between a temperature detection at the central portion and temperature detection at the end portions, in the longitudinal direction, of a fixing roller is provided for controlling, whereby it is possible shorten a rise time.

However, in these prior arts, two-split coils are alternately energized (heated) at intervals of every given time with reference to a data table of a given heating ratio. Further, in a high frequency IH control, a high-temperature side as well is heated for the given time, thus irregularities in temperature result. In addition, there is the problem that because there is a limit to a minimum switching time due to the problem of a control circuit, overshooting and undershooting arise.

BRIEF SUMMARY OF THE INVENTION

One embodiment of an image forming apparatus is an image forming apparatus having a forming unit which forms an image onto a recording medium on the basis of acquired image information, a fixing unit which fixes the formed image by heating the recording medium on which the image has been formed by the forming unit, and a control unit which generates a temperature change table by detecting the temperatures of the fixing unit, and which carries out a temperature control of the fixing unit on the basis of the temperature change table.

DETAILED DESCRIPTION OF THE INVENTION

Hereinafter, an image forming apparatus and a temperature controlling method of a fixing device thereof will be described in detail with reference to the drawings.

<Image Forming Apparatus>

(Configuration of Temperature Control)

Figure 1:
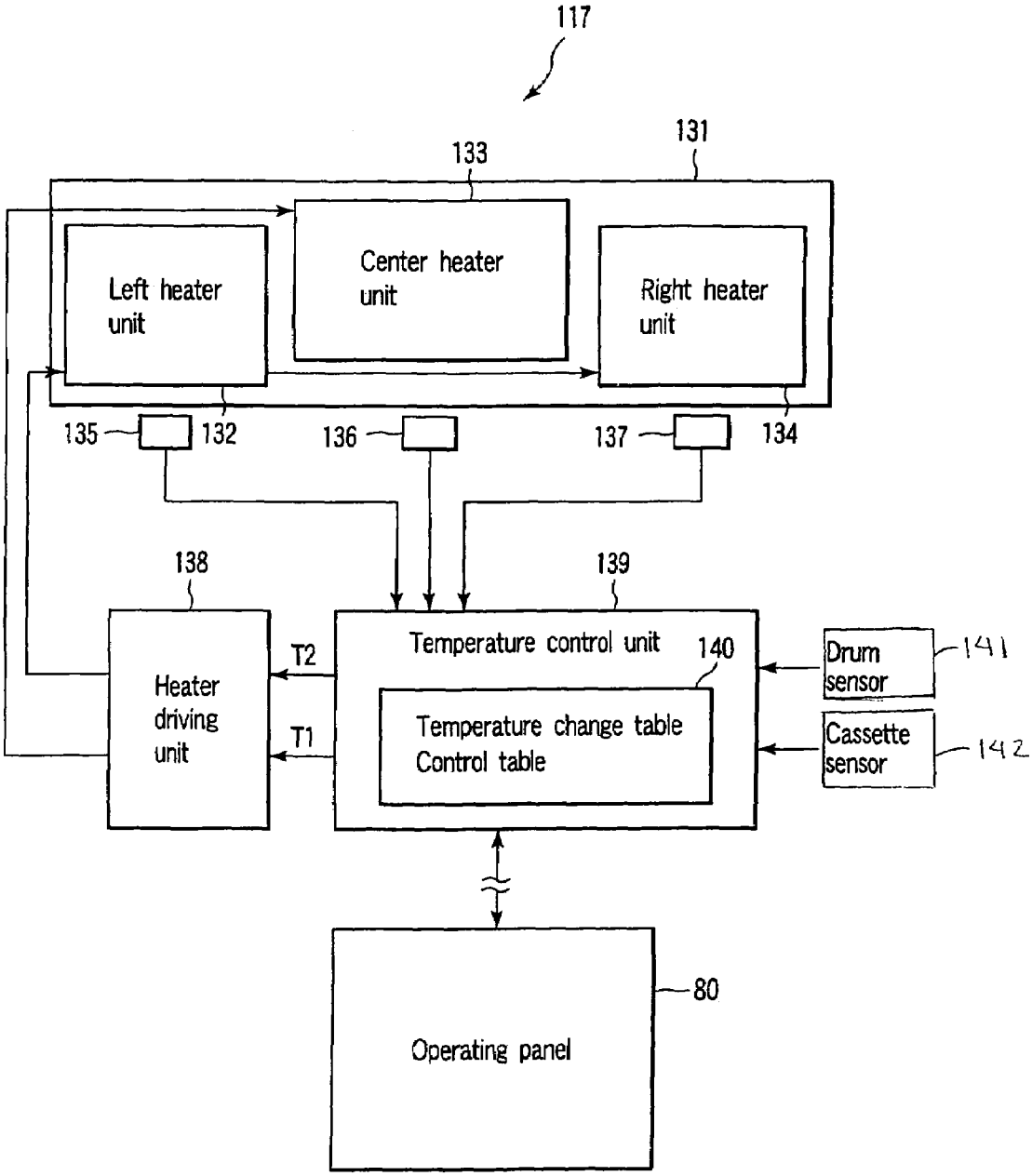
FIG. 1 is a block diagram showing a fixing unit and a temperature control unit of an image forming apparatus.

First, the configuration of the temperature control of the fixing device of the image forming apparatus will be described with reference to the drawings. FIG. 1 is a block diagram showing a fixing unit and a temperature control unit of the image forming apparatus. In FIG. 1, a fixing control unit 117 has, as an example, a fixing roller 131, temperature sensors 135, 136, and 137, a temperature control unit 139, and a heater driving unit 138. A left heater unit 132, a center heater unit 133, and a right heater unit 134 are built in the fixing roller 131. The temperature sensors 135, 136, and 137 detect the temperatures of the respective units of the fixing roller 131. The temperature control unit 139 receives the temperature signals thereof and signals from a drum temperature sensor 141 and a cassette temperature sensor 142, and incorporate a CPU for generating and maintaining a temperature change table and other control tables 140, or the like. The heater driving unit 138 receives control signals therefrom and drives the respective heater units 132, 133, and 134. Further, the temperature control unit 139 is operated by an operating panel 80.

(Mechanical Configuration)

Figure 6:
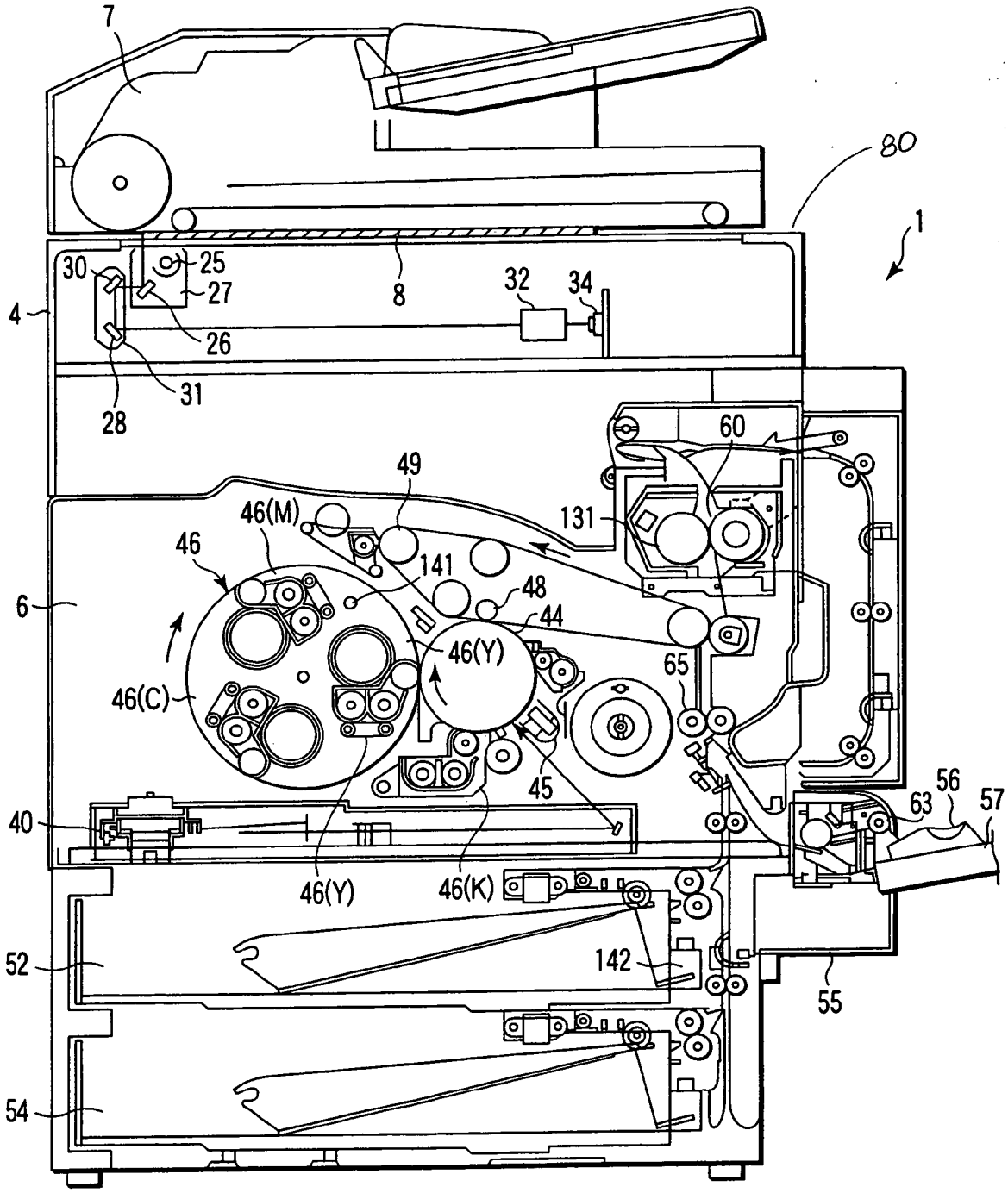
FIG. 6 is a cross sectional view showing one example of a mechanical configuration of the image forming apparatus.

Next, one example of the configuration of the image forming apparatus will be described. FIG. 6 is a cross sectional view for explanation of a mechanical configuration of the image forming apparatus. This image forming apparatus 1 is composed of a color scanner unit 4 serving as an image reading unit, a printer unit 6, an automatic document feeder (hereinafter, ADF) 7, and the operating panel 80 which will be described later, etc.

The scanner unit 4 has the ADF 7 at the top portion thereof, and there is provided a transparent glass document platen 8 which is disposed so as to face the ADF 7 in a state of being closed, and on which a document is set. Below the document platen 8, an exposure lamp 25 for illuminating the document placed on the document platen 8, and a first mirror 26 for concentrating light from the exposure lamp 25 on the document and refracting the reflected light from the document, for example, to the left direction with respect to the drawing, are fixed to a first carriage 27.

The first carriage 27 is disposed so as to be movable in parallel with the document platen 8, and is made to move reciprocally below the document platen 8 by a scanning motor (not shown) via a toothed belt (not shown) or the like.

Further, below the document platen 8, a second carriage 28 which is movable in parallel with the document platen 8 is disposed. Second and third mirrors 30 and 31 which successively reflect the reflected light from the document reflected by the first mirror 26 are attached so as to be perpendicular to one another at the second carriage 28. The second carriage 28 is driven so as to be coupled with the first carriage 27 by the toothed belt that drives the first carriage 27, or the like, and is moved in parallel along the document platen 8 at a half-speed of that of the first carriage 27.

Furthermore, below the document platen 8, there are disposed an imaging lens 32 for focusing the reflected light from the third mirror 31 on the second carriage 28, and a CCD (photoelectric conversion element) 34 for receiving and photoelectrically converting the focused reflected light by the imaging lens. The imaging lens 32 is disposed so as to be movable via a driving mechanism within the plane including the optical axis of the light reflected by the third mirror 31, and forms the reflected light into an image at a desired magnification due to the image-forming lens 32 itself moving. Then, the CCD 34 photoelectrically converts the incident reflected light, and outputs an electric signal corresponding to the read document.

On the other hand, the printer unit 6 has a laser exposure device 40 serving as latent image forming means. The laser exposure device 40 has a semiconductor laser serving as a light source, a polygon mirror serving as a scanning member which continuously reflects the laser beam radiated from the semiconductor laser, a polygon motor serving as a scanning motor which drives the polygon mirror so as to be rotated at a predetermined rotation speed, and an optical system which reflects the laser beam from the polygon mirror and which guides the reflected laser beam to a photosensitive drum 44 which will be described later.

Moreover, the printer unit 6 has the freely rotatable photosensitive drum 44 which is disposed at the substantial center of the apparatus body and serves as an image carrier. The peripheral surface of the photosensitive drum 44 is exposed by the laser beam from the laser exposure device 40, and a desired electrostatic latent image is formed thereon. At the periphery of the photosensitive drum 44, there are arranged an electrifying charger 45 which electrifies the peripheral surface of the photosensitive drum 44 to a predetermined electric charge, a developing machine unit 46 which supplies a toner serving as a developer to the electrostatic latent image formed on the peripheral surface of the photosensitive drum 44 to carry out development at a desired picture image density, and a transfer charger 48 which transfers a toner image formed on the photosensitive drum 44 onto a paper.

At a position where the paper onto which the toner image is transferred by the transfer charger 48 is conveyed to, the fixing device unit 60 having the fixing roller 131 is disposed. The fixing roller 131 fixes the toner image onto the paper by pressing and heating.

At the lower portion of the apparatus body, an upper stage cassette 52 and a lower stage cassette 54 which can be respectively withdrawn from the apparatus body are disposed in a state of superimposing on one another. A large capacity feeder 55 is provided at the side of these cassettes, and a paper feeding cassette 57 serving as a hand feed tray 56 as well is mounted so as to be freely attachable and detachable above the large capacity feeder 55. In addition, there is provided the temperature sensor 142 for detecting a temperature of the cassette described above.

A resist roller pair 65 is provided at the upper stream side of the photosensitive drum 44. The resist roller pair 65 corrects an inclination of the ejected copying paper, and matches the front end of the toner image on the photosensitive drum 44 with the front end of the copying paper, and feeds the copying paper to a transfer belt unit 49 at a speed which is the same as a moving speed of the peripheral surface of the photosensitive drum 44. There is provided the temperature sensor 141 for detecting a temperature of the photosensitive drum 44.

Further, the operating panel 80 for inputting various copying conditions and a copy starting signal starting copying operation, and the like, is provided at the upper portion of the front surface of the apparatus body.

(Electrical Configuration)

Figure 7:
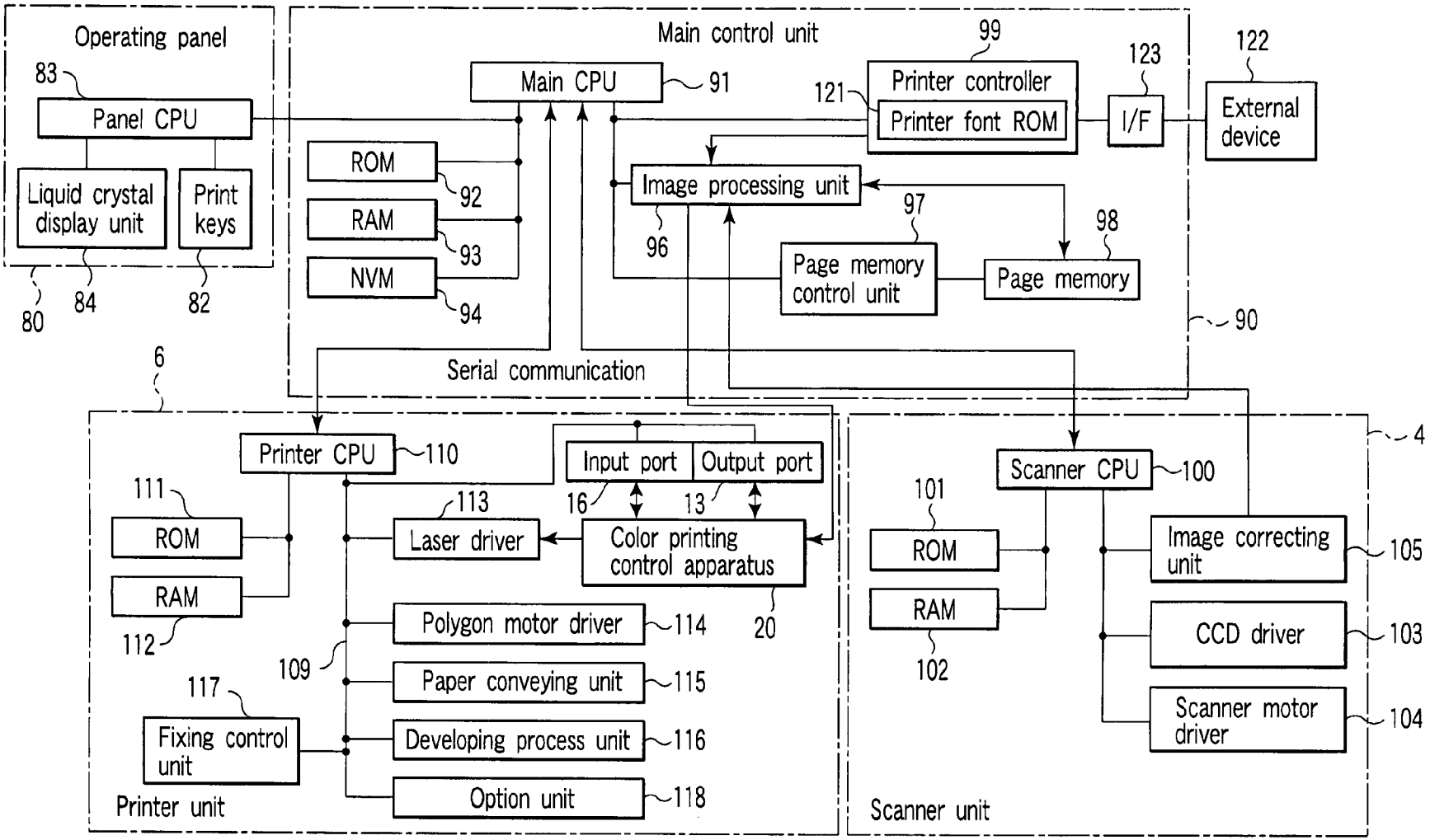
FIG. 7 is a block diagram showing one example of an electrical configuration of the image forming apparatus.

In a block diagram shown in FIG. 7, the image forming apparatus is composed of a control unit consisting of three CPUs which are the main CPU (central processing unit) 91 in the main control unit 90, a scanner CPU 100 of the color scanner unit 4, a printer CPU 110 of the color printer unit 6. It is configured such that the main CPU 91 sends operating instructions by carrying out serial communication with the printer CPU 110, and the printer CPU 110 returns a status signal to the main CPU 91. Further, it is configured such that the main CPU 91 orders operating instructions by carrying out serial communication with the scanner CPU 100, and the scanner CPU 100 returns a status signal to the main CPU 91.

The operating panel 80 is connected to the main CPU 91. The main control unit 90 is composed of the main CPU 91, the ROM 92, the RAM 93, the NVM 94, an image processing unit 96, a page memory control unit 97, a page memory 98, and a printer controller 99.

The main CPU 91 is for controlling the entire main control unit 90. In the ROM 92, a control program is stored. The RAM 93 is for temporarily storing data.

The NVM (nonvolatile random access memory: nonvolatile RAM) 94 is a nonvolatile memory which is backed up by a battery (not shown), and it is configured such that the data on the NVM 94 is maintained when the power source is turned off.

The page memory control unit 97 is for storing image data in the page memory 98, and for reading the image data. The page memory 98 has a region at which image data of a plurality of pages can be stored, and is formed such that the data in which the image data from the scanner unit 4 is compressed can be stored for each page. Font data corresponding to print data are stored in a printer font ROM 121.

The printer controller 99 includes the printer font ROM 121, and is for expanding the print data from an external device 122 such as a personal computer into image data by using the font data stored in the printer font ROM 121 at a resolution corresponding to the data showing the resolution which has been provided to the print data via an input port 16. Moreover, an external interface 123 carries out communications of various types of signals with the external device 122.

The scanner unit 4 is composed of the scanner CPU 100 for controlling the entire scanner unit 4; the ROM 101 in which a control program or the like is stored; the RAM 102 for storing data; a CCD driver 103 for driving the CCD sensor 34; the scanner motor driver 104 for controlling the rotations of a motor which moves the exposure lamp 25 and the mirrors 26, 30, and 31, etc.; and an image correcting unit 105 including a shading correction circuit for correcting irregularities in an A/D conversion circuit which converts an analog signal from the CCD sensor 34 into a digital signal and the CCD 34, or variations in a threshold level with respect to an output signal from the CCD sensor 34 due to an ambient temperature change or the like, and a line memory in which the digital signal, on which shading correction has been carried out, from the shading correction circuit is once stored.

The printer unit 6 is composed of the printer CPU 110 for controlling the entire printer unit 6; the ROM 111 in which a control program or the like is stored; the RAM 112 for storing data; a laser driver 113 for turning the light-emission (exposure) due to a semiconductor laser on-and-off; a polygon motor driver (motor control device) 114 for controlling the rotation speed of the polygon motor of the laser unit; a paper conveying unit 115 for controlling conveyance of a paper sheet through a conveying path; a developing process unit 116 for carrying out electrification, development, and transfer by using the electrifying charger 45, the developing machine unit 46, and the transfer charger 48; the fixing control unit 117 for controlling the fixing device unit 60; and the option unit 118. Further, the printer unit 6 is composed of an output port 13, the input port 16, and an image forming apparatus 20 which is the embodiment of the present invention.

Further, the image processing unit 96 and the page memory 98 are connected so as to transmit and receive image data, and the image correcting unit 105 and the image processing unit are connected so as to transmit and receive image data. In the same way, the image correcting unit 105 and the color printing control apparatus 20 are connected so as to transmit and receive image data, and similarly, the printer controller 99 and the image processing unit 96 as well are connected so as to transmit and receive image data.

<Temperature Control of Fixing Device of Image Forming Apparatus>

Figure 2:
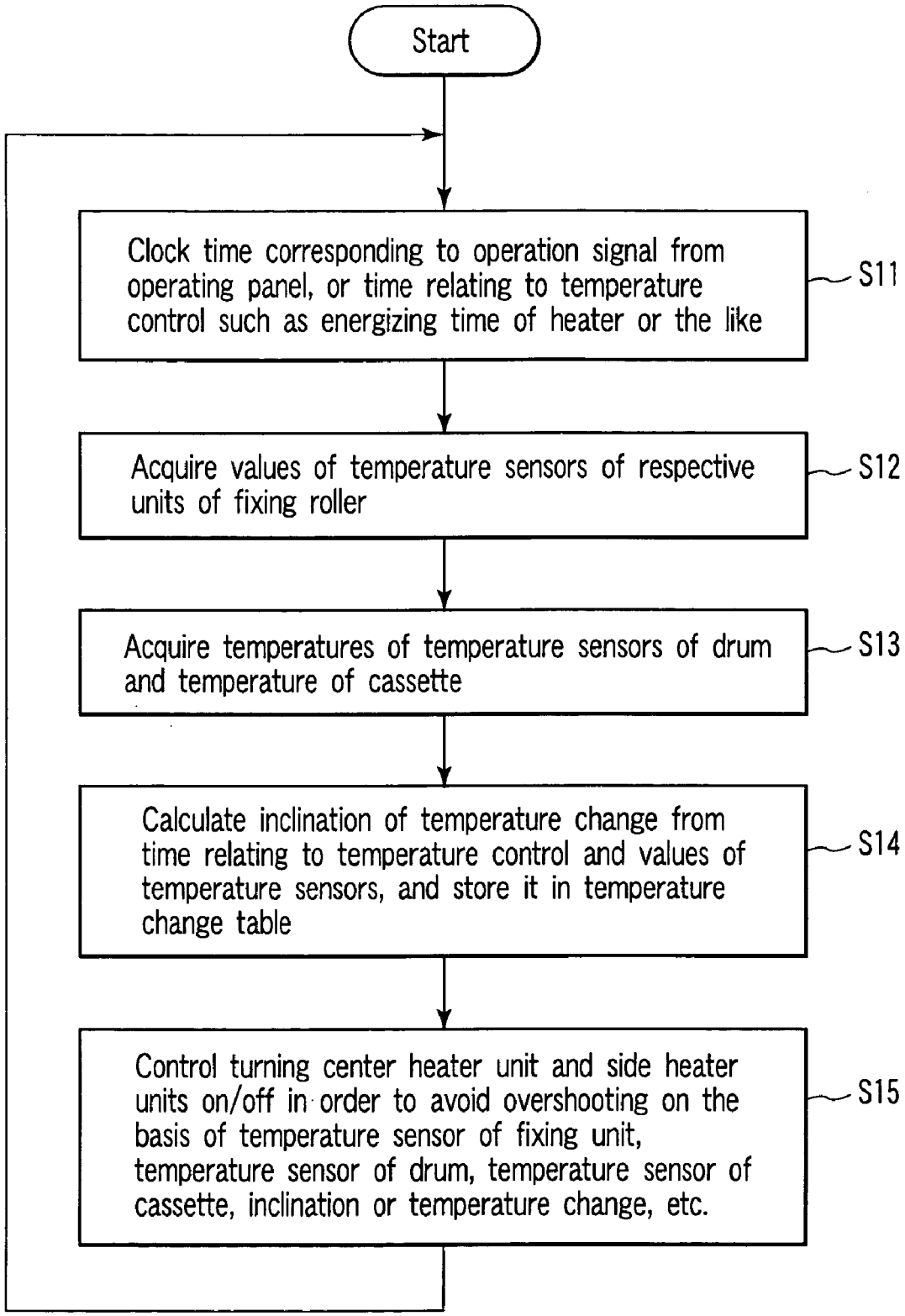
FIG. 2 is a flowchart showing one example of a temperature control of the fixing unit of the image forming apparatus.
Figure 3:
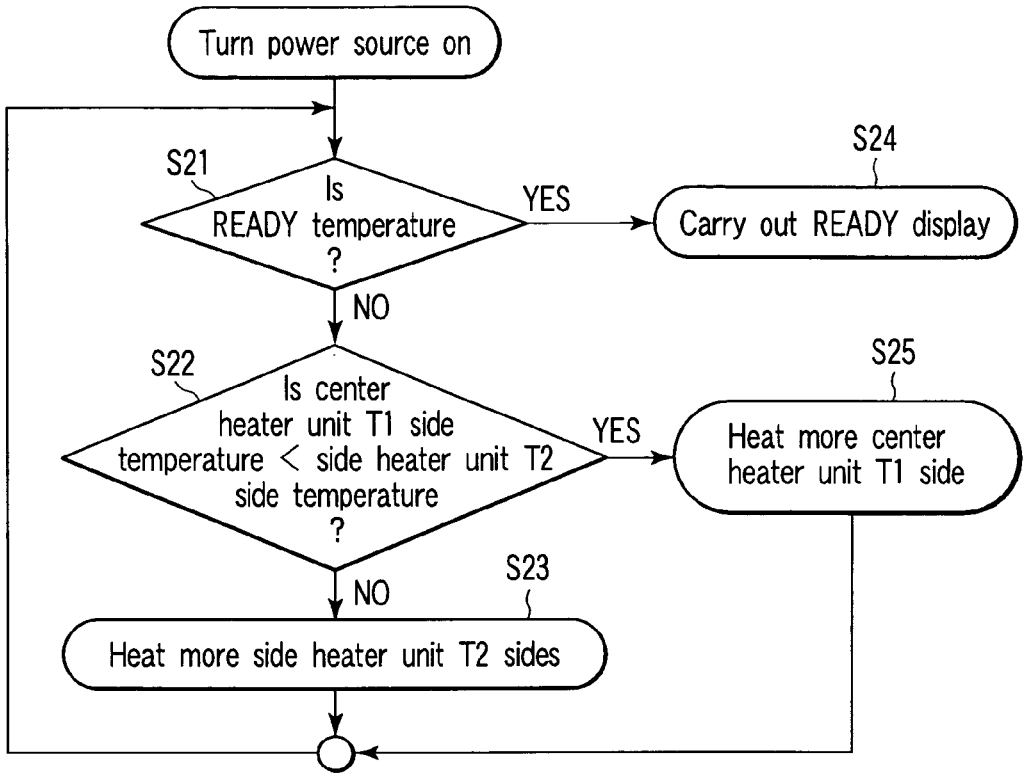
FIG. 3 is a flowchart showing another example of temperature control of the fixing unit of the image forming apparatus.
Figure 4:
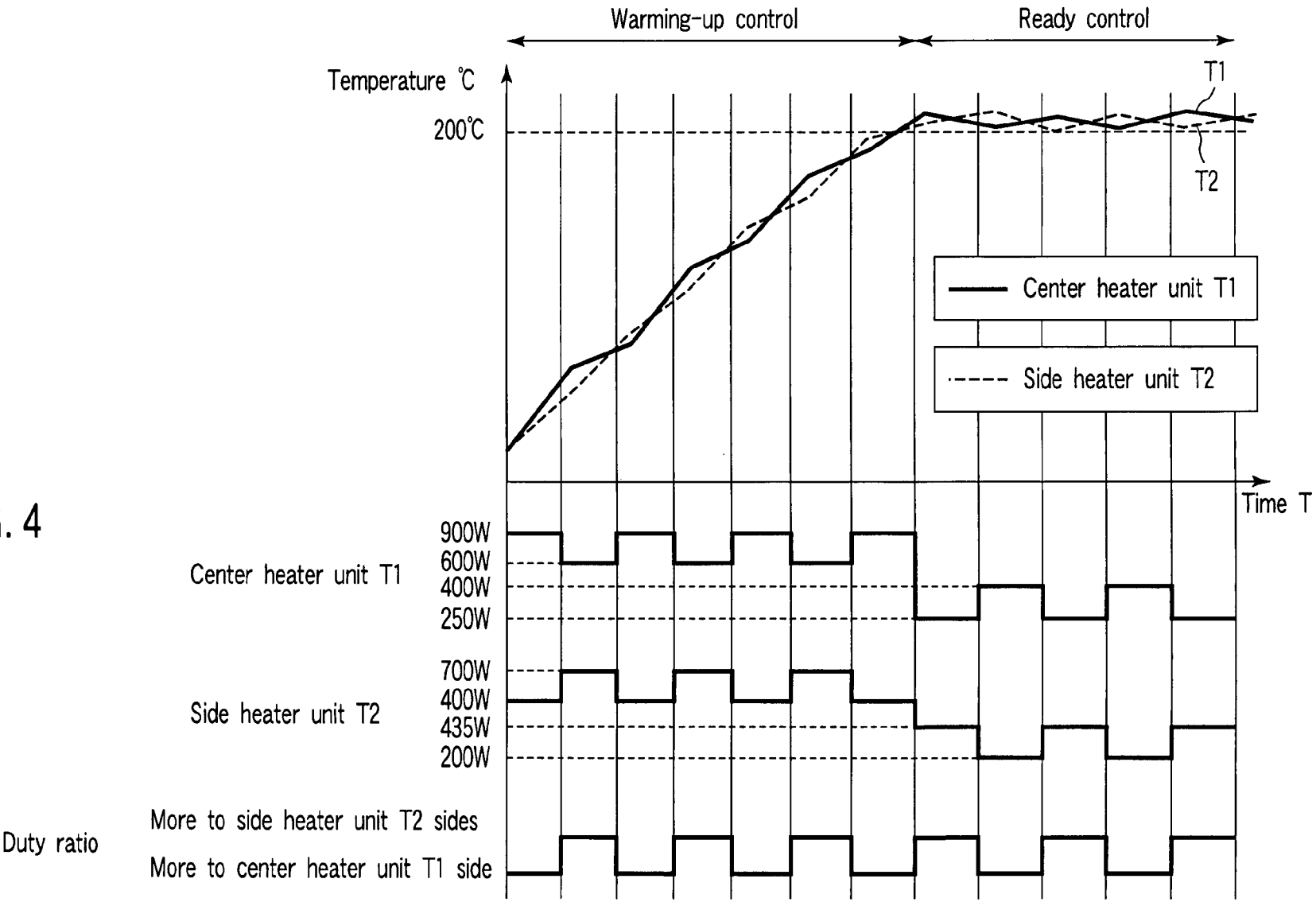
FIG. 4 is a temperature graph showing one example of temperature control of the fixing unit of the image forming apparatus.

Next, the temperature control of the fixing device of the image forming apparatus will be described in detail by using flowcharts. FIG. 2 is a flowchart showing one example of the temperature control of the fixing unit of the image forming apparatus, FIG. 3 is a flowchart showing another example of the temperature control of the fixing unit of the image forming apparatus, FIG. 4 is a temperature graph showing one example of the temperature control of the fixing unit of the image forming apparatus, and FIG. 5 is a temperature graph showing one example of the temperature control of the fixing unit of the image forming apparatus.

In the flowchart of FIG. 2, when an operation signal is provided from the operating panel 80 by the operation of the user, due to the operation of the temperature control unit 139 (this may be the printer CPU 110) included in the fixing control unit 117, the time corresponding to the operation signal and an elapsed time relating to the temperature control such as an energizing time of the heaters, or the like start to be clocked (S11). Thereafter, the values of the temperature sensors 135, 136, and 137 for detecting the temperatures of the respective units of the fixing roller 131 are acquired (S12). The temperature signals from the temperature sensor 141 of the photosensitive drum of FIG. 6, and further, the temperature sensor 142 of the cassette 52 are acquired (S13). On the basis of the values of the signals of these sensors and the aforementioned elapsed time in being clocked, an inclination of temperature change (a rate of change) is calculated, and a temperature change table is prepared (S14). The values of the temperature change table show whether the temperature change is sudden or the temperature change is slow.

Figure 5:
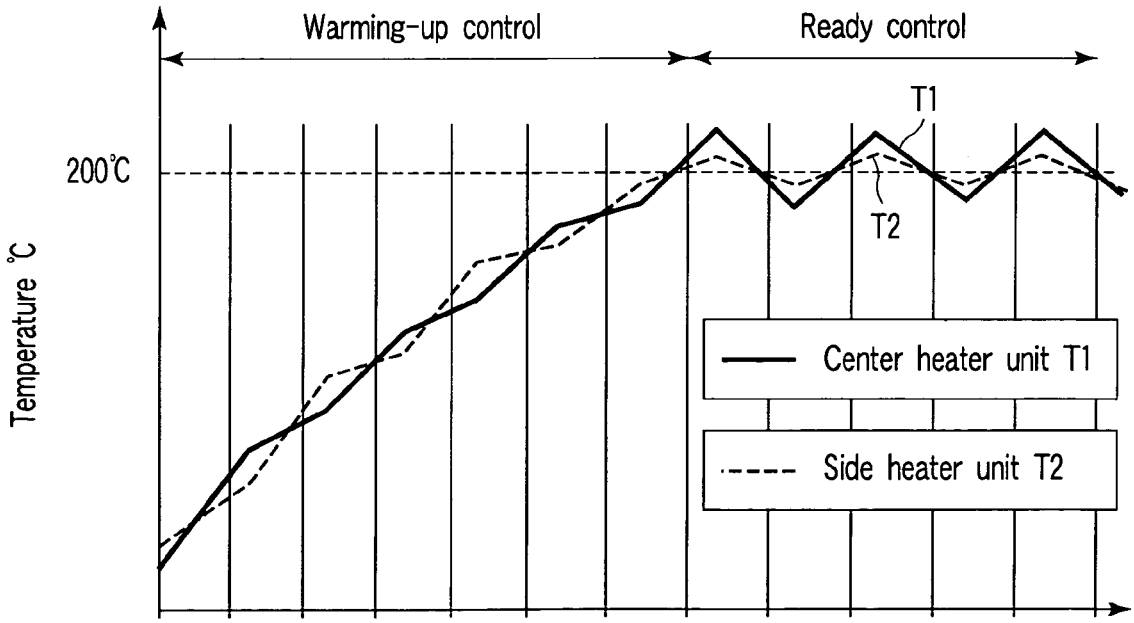
FIG. 5 is a temperature graph showing one example of temperature control of the fixing unit of the image forming apparatus.

On the basis of the temperature sensors 135, 136, and 137 of the fixing roller 131, the temperature sensor 141 of the drum, the temperature sensor 142 of the cassette, the temperature change table, and further, a control table based on the values of generation of overshooting, which are actually measured in advance, timing signals T1 and T2 with the optimum timings are supplied from the temperature control unit 139 to the heater driving unit 138 in order to avoid occurrence of overshooting as shown in a ready control period in FIG. 5. The reason for referring to the temperature of the cassette and the temperature of the drum is that there are many cases in which the ambient temperatures of the cassette, the drum, or the like affect temperature changes of the heater units. In accordance therewith, driving signals of the center heater unit 133, and the side (left and right) heater units 132 and 134 of FIG. 1 are supplied from the heater driving unit 138, and the overshooting shown in the graph of FIG. 5 is resolved as shown in the graph of FIG. 4. As a result, it is possible to carry out efficient temperature rising processing of the heater units 132, 133, and 134 of the fixing roller 131.

(Control Table)

Here, the control table described above is a control recipe which is prepared in advance in the end of trial-and-error on the basis of that the driving signals and overshooting of the heaters are actually measured. As an example, it is determined in advance by simulating, that, in accordance with a current temperature and a current temperature change, provided that what value of a driving signal is continued to supply for how long period, overshooting does not arise, and there can be maintained a state of being reaching the READY temperature, and in accordance therewith, a control table is prepared and housed. Many control tables are required because many cases have to be considered. Accordingly, as an example, when "current temperature" and "current temperature change" are detected, at least control tables corresponding to the two values among the large number of tables are selectively accessed, and the temperature control unit 139 supplies the control signals T1 and T2 having the sizes and the time lengths which the tables show, to the heater driving unit 138.

(Center Heater and Side Heater)

Moreover, the fixing roller 131 has the center heater unit 133 at the central portion and the heater units 132 and 134 at the both sides as shown in FIG. 1, and if those are not made to appropriately rise in temperature, irregularities in the temperatures arise. Accordingly, it is preferable that the it is simulated in advance that both heaters are made to rise in temperature thereof with what timings, many control tables corresponding thereto are prepared in advance, appropriate tables are read out in accordance with a situation, and switching of the center heater unit 133 (T1) and the side heater units 132 and 134 (T2) is carried out on the basis of the tables.

Further, in the case of requiring about one second from the time of actually switching a temperature until the rate of a rise in temperature is inverted due to the output following-up, for example, given that the rate of a rise in temperature of the center heater unit 133 is 2° C./second, and the rate of a rise in temperature of the side heater units 132 and 134 is 1° C./second, a temperature difference therebetween is reduced by 1° C. per one second.

Given that the current temperature of the heater unit T1 is 50° C., and the current temperature of the heater unit T2 is 55° C., as an example, the temperatures vary as follows.

| Elapsed time (seconds) | T1 | T2 |
|---|---|---|
| 0 | 50° C. | 55° C. |
| 1 | 52° C. | 56° C. |
| 2 | 54° C. | 57° C. |
| 3 | 56° C. | 58° C. |
| 4 | 58° C. | 59° C. |
| 5 | 60° C. | 60° C. |
| 6 | 62° C. | 61° C. |
| 7 | 64° C. | 62° C. |

Here, for example, because it has been already known that the temperatures are inverted after six seconds, a control table for carrying out temperature switching is provided in advance in order to avoid the overshooting which will arise at a point in time after four seconds or five seconds. This is preferably a control table in which the time is determined in consideration of not only "current time" but also the current "temperature change".

As an example of another control method, as shown in the flowchart of FIG. 3, after the power source is turned on, it reaches the READY temperature (S21), a READY display is carried out by the operating panel 80 or the like (S24). When it has not reached the READY temperature, it is determined whether or not the temperature at the center heater unit side is less than the temperatures at the side heater unit sides (S22). When the temperature at the center heater unit side is less than the temperatures at the side heater unit sides, the center heater unit 133 is activated (S25). When the temperatures at the center heater unit side is greater than the temperature at the side heater unit sides, the side heater units 132 and 134 are activated (S23). In accordance therewith, the balance of the temperatures between the center heater unit 133 and the side heater units 132 and 134 can be maintained.

Further, as an example of another control table, as shown in FIG. 4, it is preferable that the duty ratio of the heating times of the center heater unit 133 (T1) and the side heater units 132 and 134 (T2) be changed in accordance with the current "temperature change". In addition, the control signals T1 and T2 are merely outputted at 0% or 100%, as shown in FIG. 4, but it is preferable that the control signals T1 and T2 are outputted gradually by, such as, 250 W, 400 W, 600 W, and 900 W, or 200 W, 400 W, 435 W, and 700 W, or the like.

Moreover, it is preferable that a case where a paper sheet which is a recording medium is passing through the fixing roller 131 and a case of warming-up are respectively detected, and the control tables having the values corresponding to the situations are prepared, and temperature control is carried out by appropriately accessing thereto.

In accordance with various embodiments described above, the skilled in the art can realize the present invention. However, it is easy for those skilled in the art to further conceive of various modifications to these embodiments, and the present invention can be applied to various embodiments without inventive ability. Accordingly, the present invention extends over a broad range which does not contradict the disclosed principles and the novel features, and is not limited to the embodiments described above.

What is claimed is:

1. An image forming apparatus comprising:

a forming unit which forms an image onto a recording medium on the basis of acquired image information;

a fixing unit in which the formed image is fixed by heating the recording medium onto which the image has been formed by the forming unit, the fixing unit having a first heater and a second heater formed adjacent to the first heater;

a first temperature sensor which detects the temperature of the first heater;

a second temperature sensor which detects the temperature of the second heater; and a control unit which selects one of a plurality of control tables prepared in advance corresponding to the temperatures detected by the first and second temperature sensors and a change of the temperature, and controls the first and second heaters on the basis of the selected control table, wherein, when the change of the temperature is greater than or equal to a predetermined value, the control unit stops raising the temperature of the fixing unit even if it has not reached a target temperature.

2. An image forming apparatus according to claim 1, wherein the fixing unit includes a fixing roller, the first heater heats a central portion of the fixing roller, and the second heater heats both end portions of the fixing roller.

3. An image forming apparatus according to claim 2, wherein the control unit alternately carries out raising the temperature of the central portion and raising the temperature of said both end portions of the fixing roller.

4. An image forming apparatus according to claim 1, wherein the control unit carries out temperature control of the fixing unit in consideration of at least one of a signal from a temperature sensor of a photosensitive drum of the forming apparatus and a signal from a temperature sensor of a cassette in which the recording medium is housed.

5. An image forming method comprising:

forming an image on a recording medium on the basis of acquired image information;

detecting a temperature of a first heater, which heats a fixing unit fixing the image formed on the recording medium; detecting a second temperature of a second heater, which is formed adjacent to the first heater;

selecting one of a plurality of control tables prepared in advance corresponding to the detected first and second temperatures and a change of the first and second temperatures; and controlling the first and second heaters on the basis of the selected control table, wherein, when the change of the temperature is greater than or equal to a predetermined value, raising the temperature of the fixing unit is stopped even if it has not reached a target temperature.

6. An image forming apparatus comprising:

a fixing unit which, by heating a recording medium on which an image is formed, fixes the formed image, the fixing unit having a first heater and a second heater formed adjacent to the first heater;

a first temperature sensor which detects the temperature of the first heater;

a second temperature sensor which detects the temperature of the second heater; and a control unit which selects one of a plurality of control tables prepared in advance corresponding to the temperatures detected by the first and second temperature sensors, and a change of the temperature, and controls the first and second heaters on the basis of the selected control table, wherein, when the change of the temperature is greater than or equal to a predetermined value, the control unit stops raising the temperature of the fixing unit even if it has not reached a target temperature.

7. An image fixing apparatus according to claim 6, wherein the fixing unit includes a fixing roller, the first heater heats a central portion of the fixing roller, and the second heater heats both end portions of the fixing roller.

8. An image fixing apparatus according to claim 6, wherein the control unit alternately carries out raising the temperature of the central portion and raising the temperature of said both end portions of the fixing roller.

9. An image fixing apparatus according to claim 6, wherein the control unit carries out temperature control of the fixing unit in consideration of at least one of a signal from a temperature sensor of a photosensitive drum used for the image formation onto the recording medium and a signal from a temperature sensor of a cassette in which the recording medium is housed.

10. An image forming apparatus comprising:

a forming unit which forms an image onto a recording medium on the basis of acquired image formation;

a heating roller in which the formed image is fixed by heating the recording medium onto which the image has been formed by the forming unit;

a first heater which heats the heating roller, and a second heater arranged adjacent to the first heater;

a first temperature sensor arranged at a position corresponding to the first heater;

a second temperature sensor arranged at a position corresponding to the second heater; and a control unit which selects one of a plurality of control tables housed in advance, in accordance with temperatures of the first and second temperature sensors and carries out temperature control of the first and second heaters on the basis of the control table, wherein the control unit compares the temperature of the first temperature sensor with the temperature of the second temperature sensor and carries out the control to supply great power to the heater corresponding to the sensor of lower temperature.

* * * * *